US010534293B2

(12) United States Patent
Iu et al.

(10) Patent No.: US 10,534,293 B2
(45) Date of Patent: Jan. 14, 2020

(54) BARRIER MEMBERS FOR USE IN AN ELECTROGRAPHIC PRINTER

(71) Applicant: HP INDIGO B.V., Amstelveen (NL)

(72) Inventors: Kai-Kong Iu, San Diego, CA (US); Alex Feygelman, Ness Ziona (IL); Thanh Tuyet Tran, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/098,178

(22) PCT Filed: Aug. 2, 2016

(86) PCT No.: PCT/US2016/045144
§ 371 (c)(1),
(2) Date: Nov. 1, 2018

(87) PCT Pub. No.: WO2018/026357
PCT Pub. Date: Feb. 8, 2018

(65) Prior Publication Data

US 2019/0146382 A1 May 16, 2019

(51) Int. Cl.

| | |
|---|---|
| ***G03G 15/20*** | (2006.01) |
| ***G03G 15/16*** | (2006.01) |
| ***G03G 21/20*** | (2006.01) |

(52) U.S. Cl.
CPC ..... *G03G 15/1615* (2013.01); *G03G 21/20* (2013.01)

(58) Field of Classification Search
CPC ..... G03G 15/1615; G03G 21/20
See application file for complete search history.

(56) References Cited

U.S. PATENT DOCUMENTS

| | | | |
|---|---|---|---|
| 6,238,839 | B1 | 5/2001 | Tomita |
| 6,686,211 | B1 | 2/2004 | Asakawa |
| 7,527,906 | B2 | 5/2009 | Yu |
| 8,454,108 | B2 | 6/2013 | Fishkin |
| 8,833,254 | B2 | 9/2014 | Veres |
| 9,126,450 | B2 | 9/2015 | Ray |
| 2014/0295089 | A1 | 10/2014 | Li |

FOREIGN PATENT DOCUMENTS

WO WO-2014041372 A1 3/2015

*Primary Examiner* — Hoang X Ngo
(74) *Attorney, Agent, or Firm* — Michael A Dryja

(57) ABSTRACT

Barrier members for use in an electrographic printer are described. The barrier member has a first layer including thermally insulating particles embedded in a polymer composition, and a second layer including a thermally conductive metallic layer.

12 Claims, 5 Drawing Sheets

BARRIER MEMBERS FOR USE IN AN ELECTROGRAPHIC PRINTER

BACKGROUND

An electrophotographic printing system may use digitally controlled lasers to create a latent image in the charged surface of a photo imaging plate (PIP). The lasers may be controlled according to digital instructions from a digital image file. Digital instructions typically include one or more of the following parameters: image color, image spacing, image intensity, order of the color layers, etc. A printing substance may then be applied to the partially-charged surface of the PIP, recreating the desired image. The image may then be transferred from the PIP to a transfer blanket on a transfer cylinder and from the transfer blanket to the desired substrate, which may be placed into contact with the transfer blanket by an impression cylinder.

BRIEF DESCRIPTION OF THE DRAWINGS

Various features of the present disclosure will be apparent from the detailed description which follows, taken in conjunction with the accompanying drawings, which together illustrate, features of certain examples, and wherein.

DETAILED DESCRIPTION

In the following description, for purposes of explanation, numerous specific details are set forth in order to provide a thorough understanding of the present systems and methods. It will be apparent, however, that the present apparatus, systems and methods may be practiced without these specific details. Reference in the specification to "an example" or similar language means that a particular feature, structure, or characteristic described in connection with the example is included in at least that one example, but not necessarily in other examples.

Figure 1:
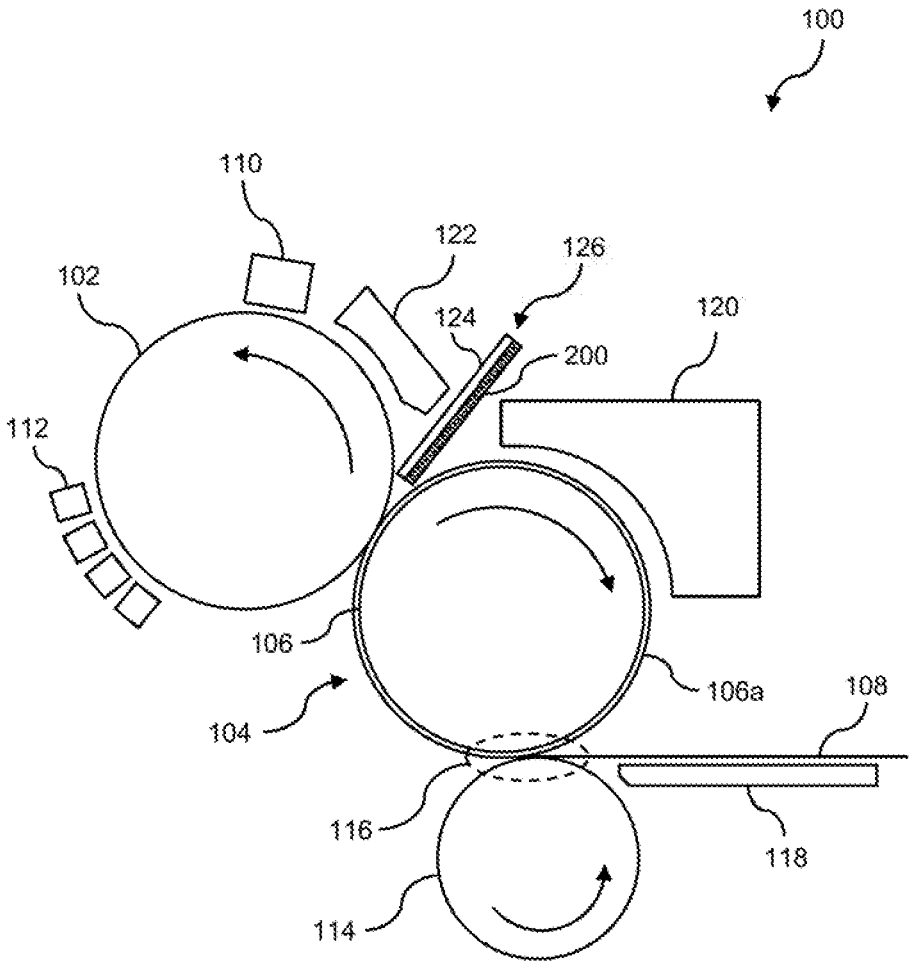
FIG. 1 is a schematic diagram showing an electrophotographic printer in accordance with an example of the present disclosure.

FIG. 1 is a schematic diagram of an electrophotographic printer 100 according to one example to print a desired image. In various implementations, the desired image may be communicated to the printer 100 in digital form. As such, the desired image may include any combination of text, graphics and images.

Electrophotographic printing refers to a process of printing in which a printing substance (e.g., a liquid or dry electrophotographic ink or toner) can be applied onto a surface having a pattern of electrostatic charge. The printing substance conforms to the electrostatic charge to form an image in the printing substance that corresponds to the electrostatic charge pattern. For example, in the example electrophotographic system 100 of FIG. 1, the desired image may be initially formed on a photo-imaging cylinder 102 using a printing substance, such as liquid ink. The printing substance, in the form of the image, may then be transferred from the photo-imaging cylinder 102 to an intermediate surface, such as the surface of a transfer element 104. The photo-imaging cylinder 102 may continue to rotate, passing through various stations to form the next image.

In the example depicted in FIG. 1, the transfer element 104 can comprise a transfer cylinder 106 and a transfer blanket 106*a* surrounding the transfer cylinder 106, and the surface of the transfer element 104 can be a surface of the transfer blanket 106*a*. The transfer element may otherwise be referred to as a transfer member 104.

In various examples, the printing substance on the transfer member 104, and the printing substance image can be heated by a heater 120. In this example, the image can then be transferred from the transfer blanket 106*a* to a substrate 108. In other examples, the transfer member 104 may not include a transfer blanket.

According to one example, an image may be formed on the photo-imaging cylinder 102 by rotating a clean, bare segment of the photo-imaging cylinder 102 under a photo charging unit 110. The photo charging unit 110 may include a charging device, such as corona wire, charge roller, or other charging device, and a laser imaging portion. A uniform static charge may be deposited on the photo-imaging cylinder 102 by the photo charging unit 110. As the photo-imaging cylinder 102 continues to rotate, the photo-imaging cylinder 102 can pass the laser imaging portion of the photo charging unit 110 that may dissipate localized charge in selected portions of the photo-imaging cylinder 102 to leave an invisible electrostatic charge pattern that corresponds to the image to be printed. In some examples, the photo charging unit 110 can apply a negative charge to the surface of the photo-imaging cylinder 102. In other examples, the charge may be a positive charge. The laser imaging portion of the photo charging unit 110 may then locally discharge portions of the photo imaging cylinder 102, resulting in local neutralized regions on the photo-imaging cylinder 102.

In this example, a printing substance may be transferred onto the photo-imaging cylinder 102 by Binary Ink Developer (BID) units 112. In some examples, the printing substance may be liquid ink. In other examples the printing substance may be other than liquid ink, such as toner. In this example, there may be one BID unit 112 for each printing substance color. During printing, the appropriate BID unit 112 can be engaged with the photo-imaging cylinder 102. The engaged BID unit 112 may present a uniform film of printing substance to the photo-imaging cylinder 102.

The printing substance may comprise electrically charged pigment particles that are attracted to the oppositely charged electrical fields on the image areas of the photo-imaging cylinder 102. The printing substance may be repelled from the charged, non-image areas. The result may be that the photo-imaging cylinder 102 is provided with the image, in the form of an appropriate pattern of the printing substance, on its surface. In other examples, such as those for black and white (monochromatic) printing, one or more ink developer units may alternatively be provided.

One example of an electrophotographic printer is a digital offset printing system, otherwise known as a Liquid Electrophotographic (LEP) printing system. In an LEP system, the printing substance may be liquid ink, such as electroink. In electroink, ink particles are suspended in a liquid carrier. In one example, ink particles can be incorporated into a resin that is suspended in a carrier liquid. Appropriate carrier liquids might include branched chain alkanes, such as isoparaffin. The ink particles may be electrically charged such that they can be controlled when subjected to an electric field. Typically, the ink particles may be negatively charged and therefore repelled from the negatively charged portions of the photo imaging cylinder 102, and attracted to the discharged portions of the photo imaging cylinder 102. The ink may be incorporated into the resin and the compound particles may be suspended in the carrier liquid. The dimensions of the ink particles may be such that the printed image does not mask the underlying texture of the substrate 108, so that the finish of the print is consistent with the finish of the substrate 108, rather than masking the substrate 108. This can enable LEP printing to produce finishes closer in appearance to offset lithography, in which ink is absorbed into the substrate 108. In other examples, the printing substance may comprise ink particles suspended in a carrier liquid. In some examples, the printing substance is a fluid.

In this example, following the provision of the printing substance on the photo-imaging cylinder 102, the photo-imaging cylinder 102 may continue to rotate and transfer the printing substance, in the form of the image, to the transfer member 104. In some examples, the transfer member 104 can be electrically charged to facilitate transfer of the image to the transfer member 104.

Once the photo-imaging cylinder 102 has transferred the printing substance to the transfer member 104, the photo-imaging cylinder 102 may rotate past a cleaning station 122 which can remove any residual ink and cool the photo-imaging cylinder 102 from heat transferred during contact with the hot blanket. At this point, in some examples, the photo-imaging cylinder 102 may have made a complete rotation and can be recharged ready for the next image. The cleaning station may be provided with a drip tray 124 to collect any residual ink removed by the cleaning station 122.

In some examples, the transfer member 104 may be disposed to transfer the image directly from the transfer member 104 to the substrate 108. In some examples where the electrophotographic printer is a liquid electrophotographic printer, the transfer member 104 may comprise a transfer blanket to transfer the image directly from the transfer blanket to the substrate 108. In other examples, a transfer component may be provided between the transfer member 104 and the substrate 108, so that the transfer member 104 can transfer the image from the transfer member 104 towards the substrate 108, via the transfer component.

In this example, the transfer member 104 may transfer the image from the transfer member 104 to a substrate 108 located between the transfer member 104 and an impression cylinder 114. This process may be repeated, if more than one colored printing substance layer is to be included in a final image to be provided on the substrate 108.

The substrate 108 may be fed on a per sheet basis, or from a roll. The latter is sometimes referred to as a web substrate. In this example, the substrate 108 can enter the printer 100 from one side of an image transfer region 116, shown on the right of FIG. 1. The substrate 108 may then pass over a feed tray 118 to the impression cylinder 114. In this example, as the substrate 108 contacts the transfer member 104, the image can be transferred from the transfer member 104 to the substrate 108.

The image transfer region 116 can be a region between the transfer member 104 and the impression cylinder 114 where the impression cylinder 114 is in close enough proximity the transfer member 104 to apply a pressure to a back side of the substrate 108 (i.e. the side on which the image is not being formed), which then transmits a pressure to the front side the substrate 108 (i.e. the side on which the image is being formed). In some examples, a distance between the transfer member 104 and the impression cylinder 114 may be adjustable to produce different pressures on the substrate 108 when the substrate 108 passes through the image transfer region 116, or to adjust the applied pressure when a substrate 108 of a different thickness is fed through the image transfer region 116.

To form a single color printed image (such as a black and white image), one pass of the substrate 108 between the impression cylinder 114 and the transfer member 104 may complete the desired image. For a multi-color image, the substrate 108 may be retained on the impression cylinder 114 and make multiple contacts with the transfer member 104 as the substrate 108 passes through the image transfer region 116. At each contact, an additional color plane may be placed on the substrate 108.

For example, to generate a four-color printed image, the photo charging unit 110 may form a second pattern on the photo-imaging cylinder 102, which then receives the second color from a second BID unit 112. In the manner described above, this second pattern may be transferred to the transfer member 104 and impressed onto the substrate 108 as the substrate 108 continues to rotate with the impression cylinder 114. This process may be repeated until the desired image with all four color planes is formed on the substrate 108. Following the complete formation of the desired image on the substrate 108, the substrate 108 may exit the machine or be duplexed to create a second image on the opposite surface of the substrate 108. In examples where the printer 100 is digital, the operator may change the image being printed at any time and without manual reconfiguration.

The printer 100 may comprise a heater 120 to heat the transfer member 104, and the printing substance image thereupon. The heat from the heater 120 may cause ink particles on the transfer member to partially melt and blend together. Where the printing substance is a liquid ink, such as electroink, much of the carrier liquid, such as isoparaffin, may be evaporated to provide a vapor. The vapor may be collected so that the carrier liquid can be reused as part of fresh printing substance in the BID units 112.

In some electrographic printers, the cleaning station 122 may be disposed adjacent to the heater 120. As the cleaning station 122 can be used to cool the photo-imaging cylinder 102 and the heater 120 can be used to heat the transfer member 104, a high temperature area and a low temperature area may be provided close together in the printer 100. The thermal contrast between these areas may be greatest when the printer 100 is first turned on, or when the area in which the printer 100 is used is relatively cold.

Carrier liquid vapor from the high temperature area may come into contact with the drip tray 124, which may be relatively cold as it is part of the low temperature area. Accordingly, the carrier liquid may condense and form droplets which fall on to the transfer member 104, resulting in print quality defects. Examples of the present disclosure provide a barrier member which may inhibit the carrier liquid condensing and dripping on the transfer member 104.

The printer 100 may comprise a barrier member 200. The barrier member 200 may be used to inhibit vapor moving from one spatial area to another. It may provide thermal insulation between areas of the printer, for example, between the high temperature area due to the heater 120 and the low temperature area due to the cleaning station 122. Further, the barrier member may provide a surface on which vapor can condense.

In one example, the barrier member 200 may be in the form of a sheet. That is, the barrier member 200 may have a length and a width that are each substantially greater than its thickness. In one example, the barrier member 200 may be in the form of a sheet which extends in a plane separating the cleaning station 122 and the heater 120. The barrier member 200 may comprise a plurality of portions. One or more of said portions may be substantially flat. Portions of the barrier material 200 may or may not be coplanar to each other. In one example, the barrier member 200 may be substantially planar across a majority (for example, at least 60%) of its surface. In some examples, a minority component of the barrier member 200 (for example, less than 40% of its surface), may be non-coplanar with the rest of the sheet. In one example, the barrier member 200 may comprise two planar portions which meet at an obtuse angle. In another example, the barrier member may comprise a curved portion. The curved portion may be curved only in one dimension. The curved portion may be curved to conform to a curve of a portion of the cylindrical surface of the transfer member 104. In another example, the barrier member may comprise a planar portion and a curved portion. In an example, the barrier member 200 may have a substantially constant thickness.

Figure 2:
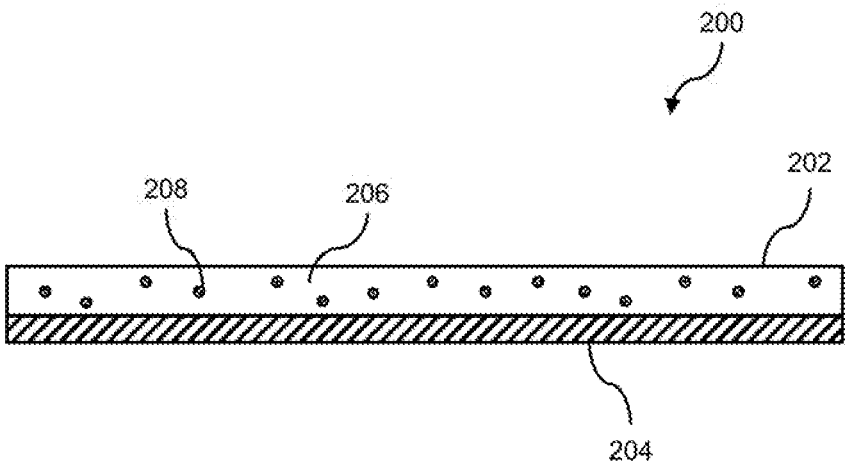
FIGS. 2 and 3 are schematic diagrams showing barrier members for use in an electrographic printer according to examples of the present disclosure.

FIG. 2 is a schematic diagram of an example of a barrier member according to the present disclosure. The barrier member 200 may comprise a plurality of layers. In one example, the barrier member may comprise a first layer 202 and a second layer 204. The first layer 202 may comprise thermally insulating particles 208 embedded in a polymer composition 206. The second layer 204 may comprise a thermally conductive metal layer.

In one example, the barrier member 200 can be disposed in the printer 100 such that the thermally insulating first layer 202 faces the cleaning station 122 (i.e. the low temperature area), and the thermally conductive second layer 204 faces the heater 120 (i.e. the high temperature area). This may allow the surface facing the heater to reach the same temperature as the heater area very quickly, without thermal energy dissipating through to the cleaning station area. Thereby, liquid carrier vapor from the transfer member 104 may be incident on a relatively hot surface, thereby minimizing liquid carrier condensation. Liquid carrier can therefore be collected primarily as vapor. The barrier member 200 may therefore inhibit the carrier liquid condensing and dripping on the transfer member 104, and thereby reduce print quality defects.

The first layer 202 may comprise thermally insulating particles 208. The thermally insulating particles 208 may be any additives which reduce the thermal conductivity of the first layer 202. In some examples, the insulating particles 208 may comprise beads. In some examples, the beads may be glass beads, ceramic beads, or plastic beads. The insulating particles 208 may be hollow beads; that is, beads which may contain air. A combination of thermally insulating particles 208 may be used in the first layer 202.

In some examples, the first layer 202 may comprise thermally insulating particles in an amount equal to or greater than 1 wt %, 2 wt %, 5 wt %, 7 wt %, 10 wt %, or 15 wt % of the first layer 202. In some examples, the first layer 202 may comprise thermally insulating particles in an amount equal to or less than 25 wt %, 20 wt %, 15 wt %, 10 wt %, or 5 wt % of the first layer 202.

The first layer 202 may also comprise a polymer composition 206. The polymer composition 206 may be a good thermal insulator as such. The polymer composition 206 may be a plastic. The plastic may be thermoplastic or thermosetting. In some examples, the plastic may be selected such that it does not substantially deform at any of the temperatures experienced in the printer 100. In some examples, the polymer composition 206 may be an elastomer.

In some examples, the polymer composition 206 may be an organic polymer, but in other examples the polymer may be inorganic (for instance, the polymer may be a silicone). Where the polymer composition 206 is an organic polymer composition, the organic polymer composition may be a polyurethane. The polymer composition 206 may consist of one polymer, or may comprise a plurality of polymers. Components for providing such polymers are described below.

The barrier member 200 may comprise a thermally conductive metallic layer 204. The thermally conductive metallic layer 204 may be a pure metal or an alloy. According to some examples, the thermally conductive metallic layer 204 may comprise aluminum, or copper. In one example, the thermally conductive metallic layer may comprise aluminum. In a further example, the thermally conductive metallic layer may consist essentially of aluminum.

Figure 3:
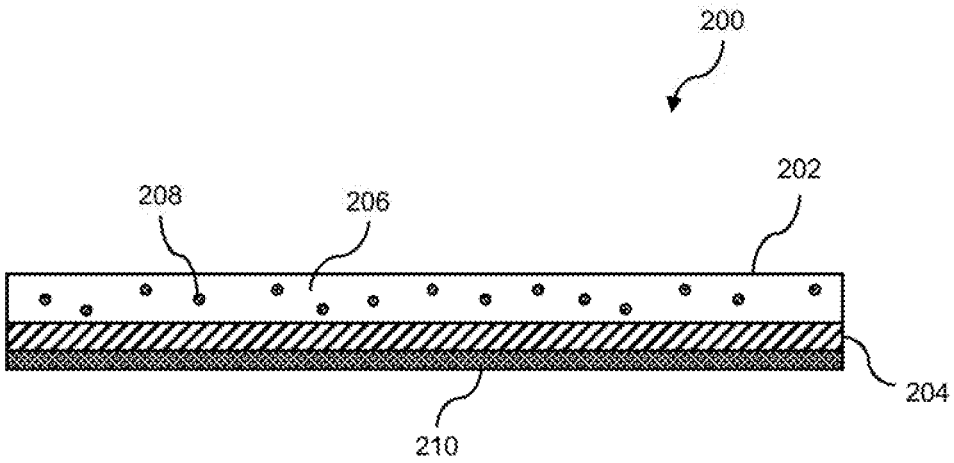

FIG. 3 is a schematic diagram of another example of a barrier member according to the present disclosure. The barrier member 200 may comprise a third layer 210 disposed on the second layer 204. In some examples, the third layer 210 may provide an oleophobic and/or hydrophobic surface. In some examples, the third layer 210 may comprise a surfactant. The third layer 210 may comprise a fluorosurfactant. The fluorosurfactant may be an anionic fluorosurfactant. In an example, the fluorosurfactant may comprise a perfluorinated chain. Fluorosurfactants may be perfluoroalkyl acids or their respective conjugate bases, including (but not limited to) perfluorocarboxylic acids and perfluorcarboxylates, perfluorosulfonic acids and perfluorosulfonates, and perfluorinated phosphonic acids and perfluorinated phosphonates. In an example, the fluorosurfactant may be a perfluorinated phosphonate. Said perfluoroalkyl acids and their conjugate bases may comprise non-perfluorinated chains. In one example, the barrier member 200 may comprise a second layer 204 comprising aluminum, and a third layer 210 comprising fluorosurfactant.

Figure 4:
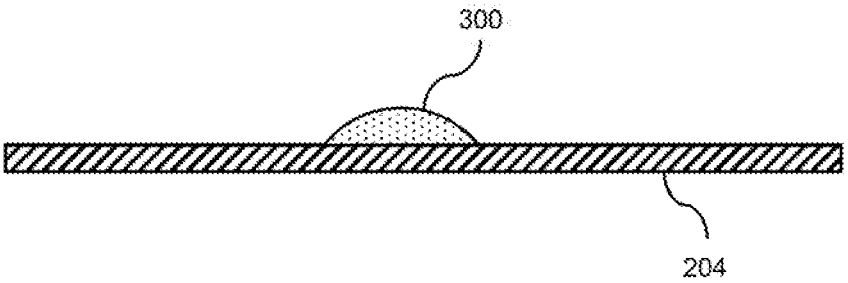
FIGS. 4 and 5 are schematic diagrams that illustrate the wetting of a liquid carrier used in an electrographic printer on barrier members according to examples of the present disclosure.
Figure 5:
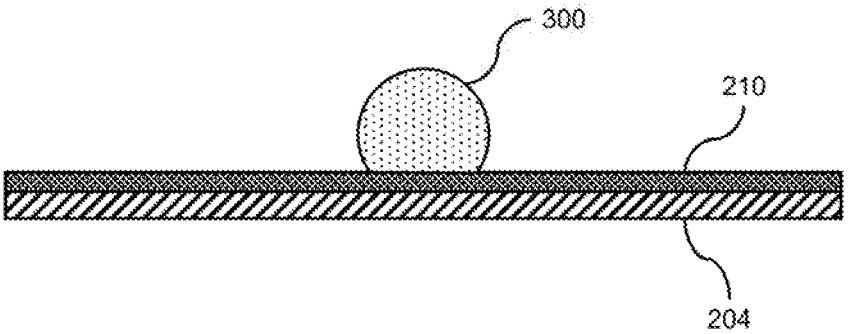

Providing barrier member 200 with a third layer 210 may encourage liquid carrier condensate disposed thereupon to form droplets more rapidly than liquid carrier condensate disposed on a surface without a third layer 210. FIG. 4 illustrates the wetting of liquid carrier 300 on the second layer 204, and shows poor droplet formation. FIG. 5 illustrates the wetting of liquid carrier 300 on the third layer 210, and shows improved droplet formation. By improving droplet formation of liquid carrier condensate on the surface of the barrier member 200, when disposed in the printer 100, droplets can run down the barrier member 200 to a droplet reservoir, rather than dripping down on to the transfer member 104 and thereby reducing print quality.

Figure 6:
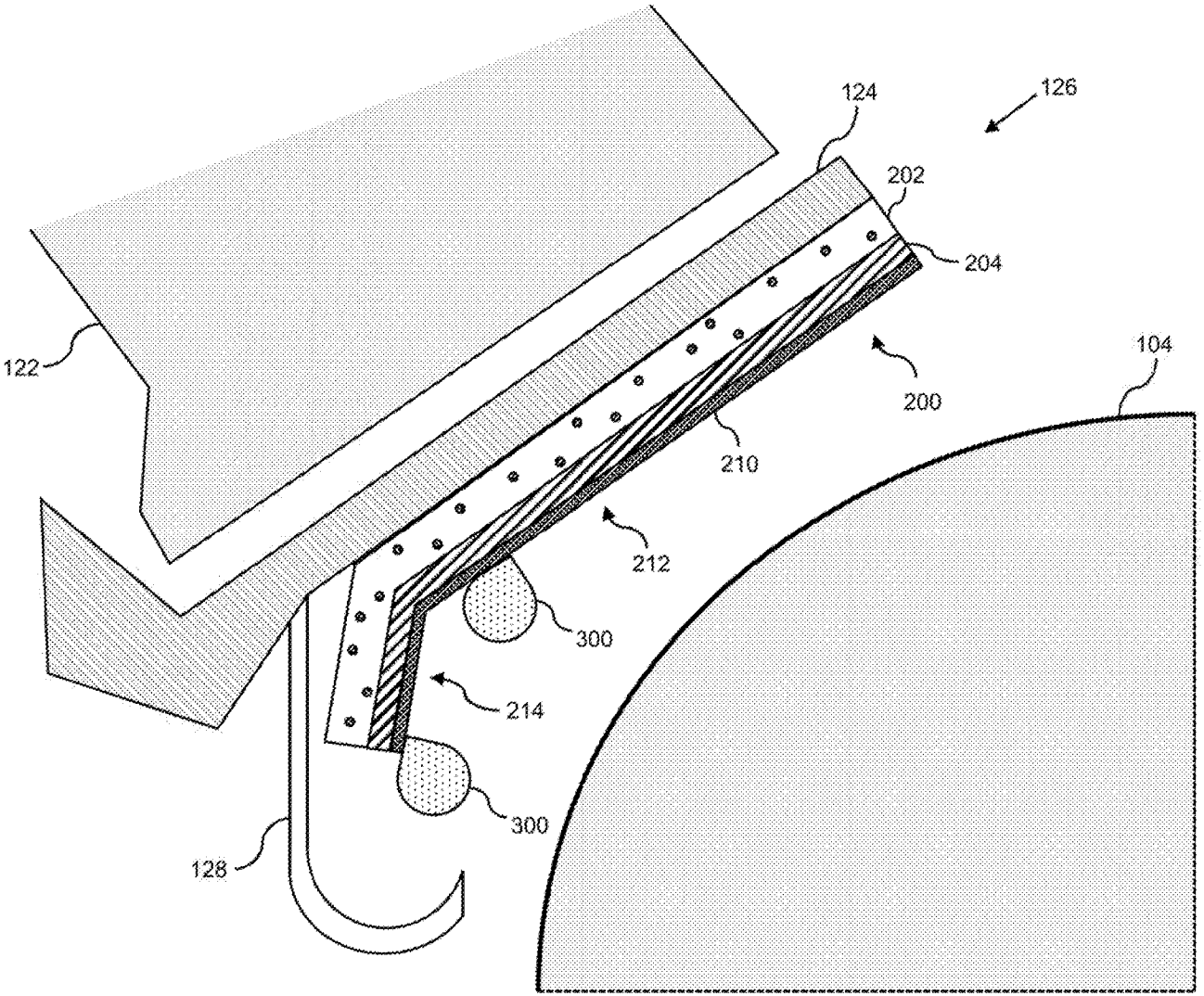
FIG. 6 is a schematic diagram showing the barrier member disposed on a support in an electrophotographic printer in accordance with an example of the present disclosure.

FIG. 6 is a schematic diagram showing the barrier member 200 disposed in a printer 100 according to one example of the present disclosure. In this example the barrier member 200 may be disposed on a support. In some examples, the support may be drip tray 124 of the cleaning station 122, such that the barrier member 200 is disposed on one side of the drip tray 124 to provide a drip tray assembly 126. In one example, the drip tray assembly 126 comprises a barrier member 200 and a drip tray 124. The drip tray assembly 126 may be arranged such that the barrier member 200 is disposed on the side of the drip tray 124 facing the transfer member 104. Disposing the barrier member 200 in the drip tray assembly 126 thus may mean that less carrier liquid condenses and drops on the transfer member 104 due to the cold drip tray 124. The drip tray assembly 126 may be provided with a droplet reservoir 128 to collect liquid carrier 300 which has run down the surface of the barrier member 200.

In other examples, the barrier member 200 might not be disposed on a support, but may be independently disposed between cleaning station 122 and the heater 120.

The barrier member 200 as shown in FIG. 6 is a sheet comprising two planar sections which meet at an obtuse angle. In this example, the barrier member 200 may be disposed in the printer 100 such that the first planar section 212 is substantially tangential to the curved surface of the transfer member 104. The second planar section 214 may be arranged such that it provides a steeper gradient for liquid carrier condensate 300 to run down and be collected in the droplet reservoir 128.

Figure 7:
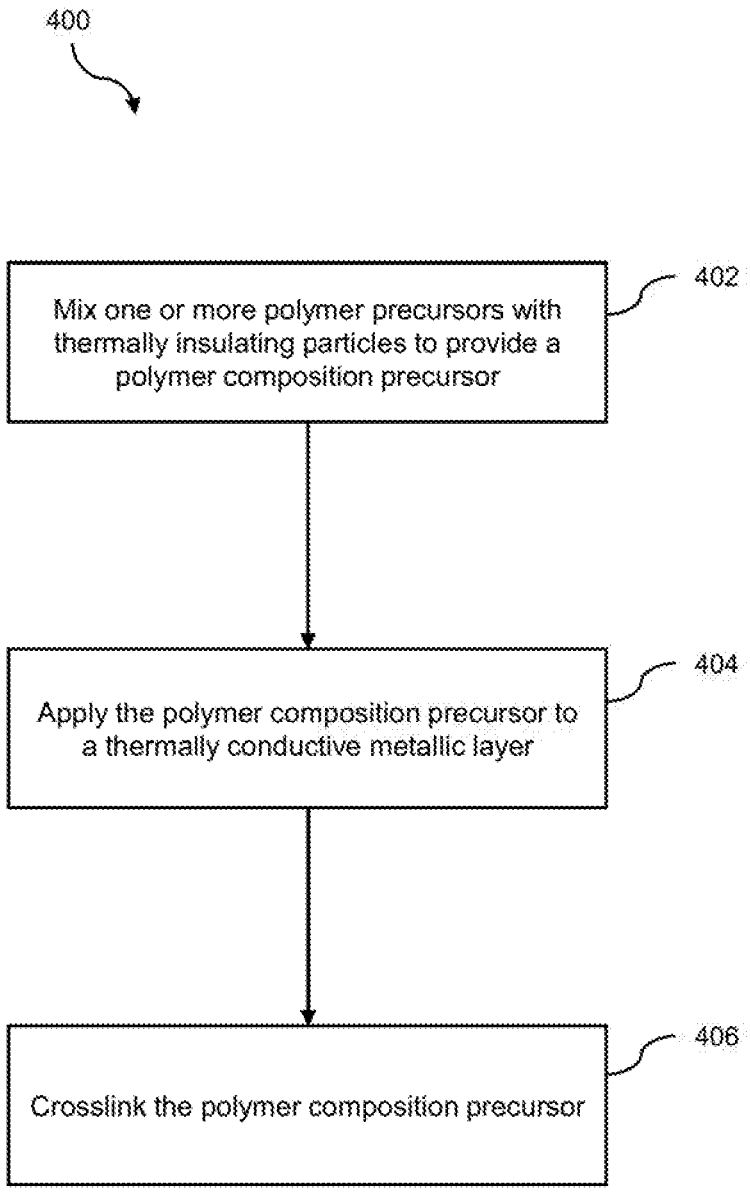
FIG. 7 is a flowchart showing a method of manufacturing a barrier member in accordance with an example of the present disclosure.

FIG. 7 is a flow chart showing an example of a method of manufacturing a barrier member 200. The method 400 may comprise mixing one or more polymer precursors with thermally insulating particles to provide a polymer composition precursor 402. In this example, polymer precursor may be mixed with thermally insulating particles then further polymer precursor added and mixed, or the polymer precursors may be mixed together before mixing with the thermally insulating particles. It may be that by mixing the polymer precursors, some or all of the polymer precursors undergo reaction in the polymer composition precursor.

The method 400 may further comprise applying the polymer composition precursor to a thermally conductive metallic layer 404, and crosslinking the polymer composition precursor to provide a polymer composition 406. The polymer composition precursor may be crosslinked (or "cured") by any method. In some examples, the polymer composition precursor may be crosslinked with heat, ultraviolet radiation, or chemical initiator.

The polymer composition precursor can be applied to a thermally conductive metallic layer 404 by pouring the precursor onto the metallic layer and then crosslinking the precursor 406. In an alternative method, the polymer composition precursor may be crosslinked to provide a polymer composition, and then the polymer composition applied to a thermally conductive metallic layer, for example the polymer composition may be attached with adhesive.

A polymer precursor may include any material which may react with itself or another polymer precursor. Where the polymer composition is a polyurethane, polymer precursors may include polyols and di- or polyisocyanates.

In some examples, the polyol component may comprise one or more of various polyols. Polyols may include polyester polyols, polyether polyols, polyolefin polyols, polycarbonate polyols and mixtures thereof. In some examples, the polyol component may comprise a polycarbonate polyester polyol, obtainable from mixtures comprising a lactone and a polyol. In some examples, the polyol component may comprise an aliphatic polyol. The polyol may be linear or branched. In one example, the polyol component may comprise a linear, aliphatic polycarbonate polyester polyol.

In some examples, the di- or polyisocyanate component may comprise monomeric and/or polymeric molecules. Di- or polyisocyanates may be aromatic or aliphatic. In some examples, the di- or polyisocyanate component may comprise an aromatic or aliphatic diisocyanate. Aliphatic diisocyanates include, but are not limited to, hexamethylene diisocyanate and isophorone diisocyanate. Aromatic diisocyanates include, but are not limited to, polymeric methylene diphenyl diisocyanate and toluene diisocyanate.

Such a method may comprise the further process of applying a coating material comprising a surfactant to the thermally conductive metallic layer 204 to provide a third layer 210. Some example surfactants include those described above. In one example, the coating material may be applied to the thermally conductive layer 204 after the polymer composition precursor is crosslinked. The coating can be applied to the exposed face of the metallic layer; that is, the side opposite to the polymer composition.

In some examples, the coating material can be applied to the thermally conductive metallic layer 204 as a coating solution (i.e. the coating material may be provided in a solvent). In one example, a solvent for use in the coating solution may be isopropyl alcohol. The coating solution may be applied to the metallic layer 204 by any method. Such methods may include spraying, brushing, or rolling the coating solution onto the metallic layer. Alternatively, the layer 204 may be dipped into a reservoir of coating solution.

Depending on the coating material, once the coating material has been applied to the metallic layer 204, the coating material may be heated to bind the coating material to the surface of the metallic layer 204 and provide a third layer 210.

In one example implementation, an isocyanate can be degassed, and left at 20° C. to 30° C. under line vacuum for a period of time (for example, approximately 8 to 24 hours). A polyol can then also be degassed, and stirred at 70° C. for a time period equal to or different from the time the isocyanate was degassed. The temperature of the polyol can then be lowered to 50° C., and hollow glass spheres (14% w/w) spin-mixed with the polyol using a centrifugation mixer to provide a uniform paste. The isocyanate can then be spin-mixed with the uniform paste in a ratio using 1:1 equivalent weight of polyol:isocyanate for a shorter period (for example, less than 3 minutes) to provide a polymer composition precursor. The polymer composition precursor can then be maintained at a lower predetermined temperature (e.g., 50° C.)

A sheet of aluminum foil can be cut to fit a mold and placed in the base of the mold. The foil may have a thickness of about 3 mil (around 0.08 millimeters). The polymer precursor composition can then be poured into the mold onto the aluminum foil, and then heated to 120° C. for a period of time (for example, approximately 3 hours) to crosslink the polymer precursor composition and provide a polymer composition.

The exposed face of the aluminum foil sheet may then be cleaned with acetone. A coating solution may be prepared and sprayed onto the exposed face of the aluminum foil sheet. One example of a coating solution is a 3 wt % solution of a perfluorinated phosphonate in isopropyl alcohol. Once sprayed onto the exposed face, the coating solution may be heated to 50° C. for a period of time (for example, 3 hours) to bind the perfluorinated phosphonate to the aluminum surface.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A barrier member for use in an electrographic printer, the barrier member comprising:

a first layer comprising thermally insulating particles embedded in a polymer composition;

a second layer comprising a thermally conductive metallic layer; and a third layer comprising a surfactant.

2. The barrier member according to claim 1, wherein the barrier member is in the form of a sheet.

3. The barrier member according to claim 1, wherein the thermally insulating particles comprise glass beads, ceramic beads, plastic beads, or a combination thereof.

4. The barrier member according to claim 3, wherein the beads are hollow.

5. The barrier member according to claim 1, wherein the first layer comprises thermally insulating particles in an amount equal to or greater than 5 wt % of the first layer.

6. The barrier member according to claim 1, wherein the surfactant is a fluorosurfactant.

7. The barrier member according to claim 1, wherein the second layer comprises aluminum or copper.

8. The barrier member according to claim 1, wherein the polymer composition comprises a polyurethane.

9. A drip tray assembly comprising a barrier member as described in claim 1 and a drip tray.

10. A method of manufacturing a barrier member for use in an electrographic printer, the method comprising:

(a) mixing one or more polymer precursors with thermally insulating particles and adding a further polymer of the one or more polymer precursors to provide a polymer composition precursor;

(b) applying the polymer composition precursor to a thermally conductive metallic layer; and (c) crosslinking the polymer composition precursor.

11. The method according to claim 10, further comprising applying a coating material comprising a surfactant to the thermally conductive metallic layer.

12. A method of manufacturing a barrier member for use in an electrographic printer, the method comprising applying a polymer composition with thermally insulating particles embedded therein to a thermally conductive metallic layer, and applying a coating material comprising a surfactant to the thermally conductive metallic layer.

* * * * *